United States Patent [19]

Fields, Jr.

[11] Patent Number: 4,826,158

[45] Date of Patent: May 2, 1989

[54] BODY STRETCHING AND EXERCISING DEVICE

[76] Inventor: Thomas H. Fields, Jr., 405 Roselawn Ave., Monroe, La. 71201

[21] Appl. No.: 151,193

[22] Filed: Feb. 1, 1988

[51] Int. Cl.[4] ..... A63B 23/00

[52] U.S. Cl. ..... 272/144; 272/903; 272/146

[58] Field of Search ..... 272/903, 144, 63, 127, 272/146, 72, DIG. 4, 121

[56] References Cited

U.S. PATENT DOCUMENTS

| | | | |
|---|---|---|---|
| 1,521,487 | 12/1924 | Turner | 272/127 |
| 1,982,872 | 12/1934 | Husted | 272/72 |
| 3,653,715 | 4/1972 | Drabert et al. | 272/69 |
| 3,658,327 | 4/1972 | Thiede | 272/72 |
| 4,046,373 | 9/1977 | Kim | 272/903 |
| 4,241,915 | 12/1980 | Noble et al. | 272/144 |

FOREIGN PATENT DOCUMENTS

| | | | |
|---|---|---|---|
| 2727008 | 1/1979 | Fed. Rep. of Germany | 272/121 |
| 990243 | 1/1983 | U.S.S.R. | 272/903 |
| 607460 | 8/1948 | United Kingdom | 272/144 |

*Primary Examiner*—Richard J. Apley
*Assistant Examiner*—Franklin L. Gubernick
*Attorney, Agent, or Firm*—John M. Harrison

[57] ABSTRACT

A body stretching and exercising device which is characterized by a frame fitted with upward-standing hand rails, a stationary foot support mounted on one end of the frame and a carriage having one end pivotally attached to the frame and slidably receiving a foot trolley. The carriage can be pivoted from a substantially horizontal position within the frame to an acute angle with respect to the frame, in order to facilitate placing one foot on the stationary foot support and the other foot on the foot trolley and stretching leg and groin muscles at various selected angles with respect to the horizontal. In a most preferred embodiment, a pair of slotted plates are disposed in spaced, parallel relationship on the frame and are provided with slots to receive one end of a carriage support which is pivoted to the carriage, in order to elevate the carriage and foot trolley to a selected stretching angle with respect to the horizontal.

14 Claims, 2 Drawing Sheets

BODY STRETCHING AND EXERCISING DEVICE

BACKGROUND OF THE INVENTION

1. Field of the Invention

This invention relates to exercising and stretching equipment and more particularly, to a body stretching and exercising device which includes a horizontally-mounted frame provided with hand rails and a stationary foot support mounted at one end thereof. A carriage is also provided, with one end of the carriage pivotally mounted on the frame and a foot trolley is constrained to traverse the carriage when the carriage is both horizontally oriented against the frame and tilted at a selected angle with respect to the frame. The body stretching and exercising device is used by placing one foot on the stationary foot support attached to the frame and the opposite foot on the foot trolley and stretching the leg and groin muscles as the foot trolley traverses the carriage. The carriage may be positioned at a selected angle with respect to the horizontally-oriented frame by operation of a carriage support, which pivotally extends from the carriage to a selected one of several slots located in a pair of slotted plates provided in the frame.

One of the problems associated with sports such as Karate, is the proper stretching and warming of leg and groin muscles, in order to effect certain kicks and other leg movements which are required in the sport. Various kicks such as side thrust kicks, front snap kicks, roundhouse kicks, back kicks and the like, require a high degree of dexterity, as well as muscle control and flexibility, in order to execute properly. It follows that the efficient and proper execution of such kicks depends on proper warm-up and stretching of the leg and groin muscles. This warm-up and stretching prerequisite is particularly important under circumstances where leg kicks to the head and chest are to be executed, wherein the foot must be raised to head and chest height for proper execution of the kick. A common casualty in the sport of Karate is the "pulled muscle" which often results from the poor execution of kicks and other leg movements prior to proper warm-up and stretching. Such injuries are quite painful and disabling and need not occur under circumstances where a proper warm-up and muscle-stretching is undertaken prior to execution of the desired moves.

2. Description of the Prior Art

Many devices are known in the prior art for exercising and stretching various body members. Typical of these devices are the exercising apparatus incorporated in the following patents, which are summarized as follows. A copy of these patents is provided with this application. U.S. Pat. No. 3,589,720, dated June 29, 1971, to Alexander Agamian, details an "Exercise Apparatus with Movable Hand and Foot Platforms". The device includes a handrail carriage, a foot slider carriage and a longitudinal track guide means, the latter of which receives the handrail carriage and the foot slider carriage in slidable relationship. The apparatus may further include means for retaining an adjustable drag or resistance between the handrail carriage and the foot carriage. A "Body Stretcher System" is detailed in U.S. Pat. No. 4,506,884, dated March 26, 1985, to Stuart M. Hankin. This patent details a hinged, folding base with folding legs and a detachable, user-supporting handle structure. In the extended position, the base includes a pair of tracks which receive two carts. Each cart is provided with a cushioned, pivotal platform and a user grasping the handle structure may support one leg on each cart and stretch his or her muscles, particularly those associated with the legs, either by kneeling in whole or in part, or by placing other portions of the legs on the carts. Suitable stops and measuring indicia may be provided, as well as a quick-release cart removal. A second, non-folding embodiment may include modified handle structure, along with line and pulley elements for drawing the carts together, either manually or electrically. U.S. Pat. No. 4,679,786, dated July 14, 1987, to Robert E. Rodgers, details a "Universal Exercise Machine". The device is characterized by an elongated frame and four slides attached to the frame, which slides are adapted to travel along parallel paths to facilitate a reciprocating motion. Each slide is connected to a chain or cable segment to facilitate a reciprocating cable motion. The motion is coupled to elongated cables which are attached to gears, thereby causing reciprocation of clutches and impulsing a flywheel in a single direction to cause rotation.

It is an object of this invention to provide a body stretching and exercising device which is characterized by a frame, a stationary foot support attached to one end of the frame and a carriage pivoted at one end to the frame and provided with a foot trolley for traversing the carriage responsive to placing one foot on the stationary foot support and the other foot on the foot trolley.

Another object of the invention is to provide a body stretching and exercising device which is useful in the sport of Karate, track and other sports requiring extensive stretching of the leg and groin muscles, which device includes a frame having a carriage pivotally attached thereto, with a stationary foot support located at one end of the frame and a foot trolley slidably mounted on the carriage, in order to facilitate stretching of the leg and groin muscles by placing one foot on the stationary foot support and the other foot on the foot trolley.

Still another object of the invention is to provide a new and improved body stretching and exercising device which includes a horizontally-mounted frame provided with handrails and having a stationary foot support mounted on one end thereof., a carriage having one end pivotally mounted to the frame adjacent to the stationary foot support and the opposite end adjustable in angular relationship with respect to the frame; and a foot trolley slidably attached to the carriage for exercising the leg and groin muscles by placing one foot on the stationary foot support and the other foot on the foot trolley.

Still another object of the invention is to provide a body stretching and exercising device for warm-up exercising and stretching, which device includes a horizontally-oriented, portable frame which includes a pair of parallel support members; a stationary foot support rigidly mounted on one end of the support members; a carriage pivotally attached to the frame at the stationary foot support and fitted with a carriage support for adjustable securing the carriage in a selected angular relationship with respect to the frame; and a foot trolley slidably mounted on the carriage for stretching the leg and groin muscles responsive to placing one foot on the stationary foot support and the other foot on the foot trolley and causing the foot trolley to traverse the carriage.

SUMMARY OF THE INVENTION

These and other objects of the invention are provided in a new and improved body stretching and exercising device which includes a horizontally-mounted frame adapted for resting on a flat surface; handrails extending from both ends of the frame in parallel, upward-standing relationship; a stationary foot support mounted on one end of the frame for receiving one foot of an exerciser; a carriage pivoted at one end to the frame adjacent to the stationary foot support, with the opposite end of the carriage adjustable from parallel to angular relationship with respect to the frame; and a foot trolley adapted to traverse the carriage responsive to placing the other foot thereon and stretching the leg and groin muscles with the carriage positioned at a selected angle with respect to the frame.

Brief Description of the Drawings

The invention will be better understood by reference to the accompanying drawings, wherein.

DESCRIPTION OF THE PREFERRED EMBODIMENTS

Figure 1:
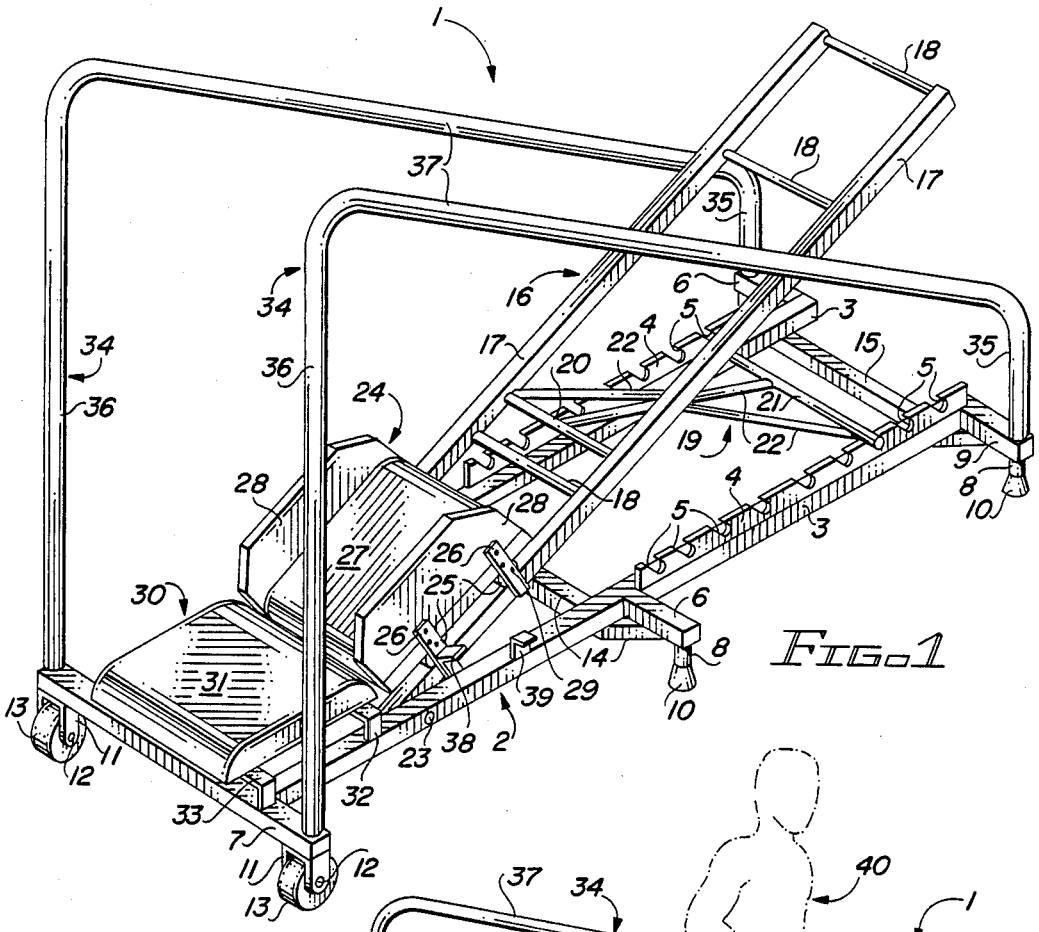
FIG. 1 is a perspective view of a preferred embodiment of the body stretching and exercising device of this invention.

Referring initially to FIGS. 1, 4, 9 and 10 of the drawings, in a preferred embodiment the body stretching and exercising device of this invention is generally illustrated by reference numeral 1. The body stretching and exercising device 1 is characterized by a horizontally-disposed frame 2, which includes a pair of parallel, spaced support members 3, joined at one end by an end bracket 7 and at the opposite end by an end frame brace 15. A pair of central leg brackets 6 project outwardly from the support members 3, respectively, approximately midway between the end bracket 7 and the end frame brace 15 to mount a pair of downwardly-extending legs 8, each of which legs 8 is provided with a protective foot 10. A central frame brace 14 spans the support members 3 and the leg brackets 6, in order to brace the center section of the support members 3, as illustrated. A pair of handrails 34 are defined by a pair of rear handrail legs 36, welded or otherwise fixedly attached to opposite ends of the end bracket 7 of the frame 2, the rear handrail legs 36 extending upwardly and curving forwardly to define parallel central handrail segments 37, respectively. Similarly, parallel forward handrail legs 35 extend from the spaced forward leg brackets 9 upwardly to join the central handrail segments 37, as illustrated. The handrails 34 are oriented above the frame 2 in spaced, parallel relationship, in order to stabilize a user of the body stretching and exercising device 1, as hereinafter further described. A pair of slotted plates 4 are also provided on each of the support members 3 forwardly of the central leg bracket 6 and extending in parallel relationship to the forward leg brackets 9, as illustrated. Each slotted plate 4 is further provided with multiple, spaced, rearwardly-inclined slots 5, for purposes which will be hereinafter further described. A stationary foot support 30 is secured to each of the support members 3 by means of spaced sets of forward foot support brackets 32 and companion rear foot support brackets 33 and a padded support base 31 is provided in the stationary foot support 30 for receiving one foot of an exerciser, as further hereinafter described. In a most preferred embodiment of the invention, a downwardly-extending wheel clevis 11 is secured to each end of the end bracket 7 and rotatably receives a wheel 13, mounted on a clevis pin 12, as illustrated in FIG. 1.

Referring now to FIGS. 1 and 5–8 of the drawings, a carriage 16 is characterized by a pair of spaced, substantially parallel carriage rails 17, joined by multiple, spaced rail spacers 18 and pivoted at one end to the support members 3 by means of a pivot bar 23. In a most preferred embodiment of the invention, the carriage 16 is pivotally secured to the support members 3 adjacent to the stationary foot support 30, to facilitate angular adjustment of the opposite end of the carriage 16 with respect to the frame 2. In order to implement this adjustment at a selected angle, a carriage support 19 extends from pivotal attachment to the carriage rails 17, to the slotted plates 4 mounted on the support members 3 of the frame 2, respectively. In yet another preferred embodiment of the invention, the carriage support 19 is further characterized by a carriage rail bar 20, which is pivotally mounted in the carriage rail 17 and multiple connector bars 22, which extend from fixed attachment to the carriage rail bar 20, to a slotted plate bar 21, which is designed to removably seat in a selected one of the slots 5 provided in each slotted plate 4, as illustrated. Accordingly, it will be appreciated by those skilled in the art that the free end of the carriage 16 can be elevated and the carriage 16 adjusted to a selected angle with respect to the horizontal support members 3 of the frame 2, by pivoting the carriage rail bar 20 in the carriage rail 17 and inserting the slotted plate bar 21 into selected ones of the parallel slots 5. Referring again to FIGS. 1 and 5–8, a foot trolley 24 is slidably mounted on the carriage rails 17 of the carriage 16 by means of four trolley wheels 25 and cooperating trolley guides 26. The L-shaped trolley guides 26 are secured in pairs to the sides 28, which are upward-standing from the padded trolley base 27, by means of guide fasteners 29. Furthermore, the bottom, inwardly-turned segments of the trolley guides 26 extend beneath the carriage rails 17, respectively, in order to maintain the trolley wheels 25 of the foot trolley 24 in slidable relationship on the carriage rails 17, respectively, of the carriage 16. Accordingly, it will be appreciated that the foot trolley 24 can be made to traverse the parallel carriage rails 17 of the carriage 16 responsive to placement of one foot on the stationary foot support 30 and the other foot on the foot trolley 24, in order to stretch groin and leg muscles, as desired. A trolley lock bracket 38 extends outwardly from one of the trolley guides 26 and is oriented for alignment with a frame lock bracket 39, projecting from one of the support members 3, in order to secure the foot trolley 24 to the frame 2, when the body stretching and exercising device 1 is being transported from place to place.

Figure 2:
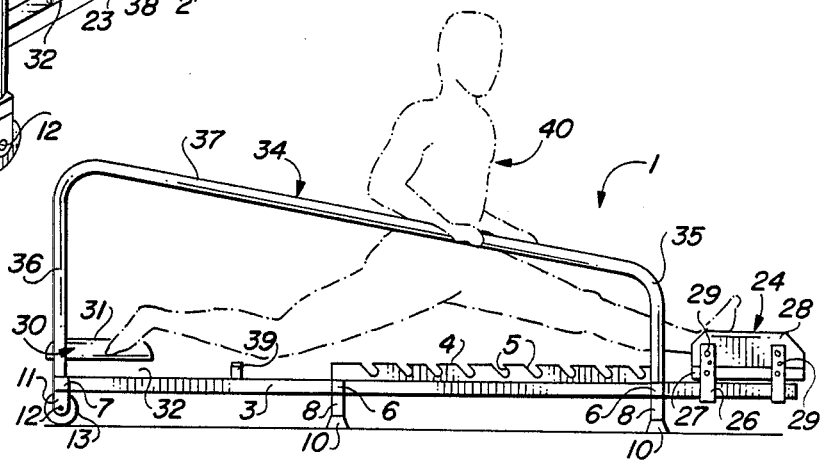
FIG. 2 is a left side elevation of the body stretching and exercising device illustrated in FIG. 1, with the carriage oriented in horizontal configuration.
Figure 3:
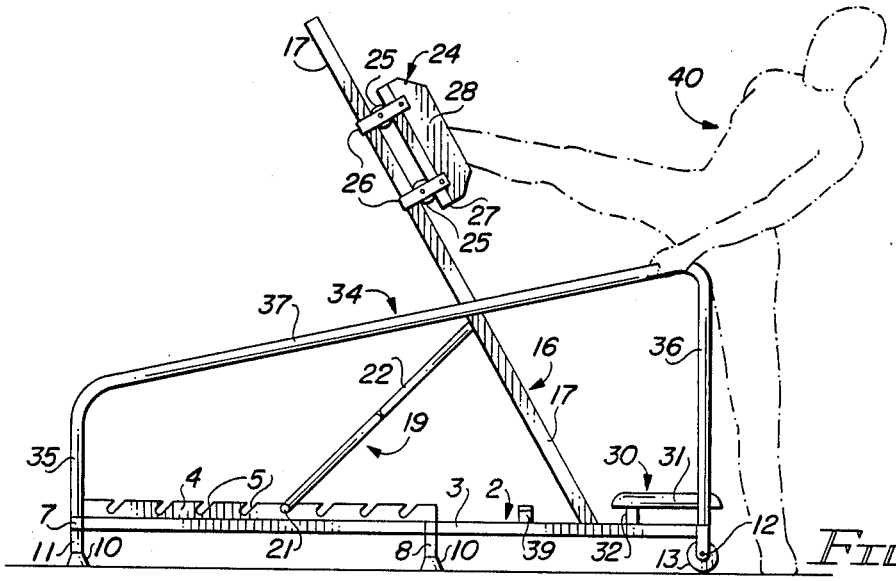
FIG. 3 is a left side elevation of the body stretching and exercising device illustrated in FIG. 1, with the carriage extended and adjustably supported in angular relationship with respect to the frame.
Figure 4:
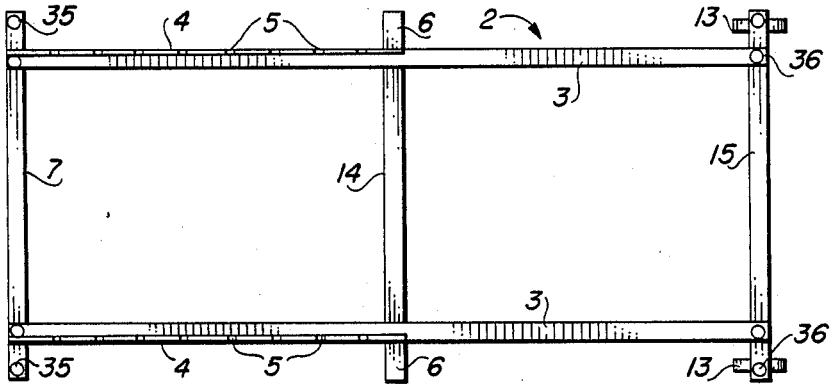
FIG. 4 is a top view of the frame element of the body stretching and exercising device illustrated in FIG. 1.
Figure 5:
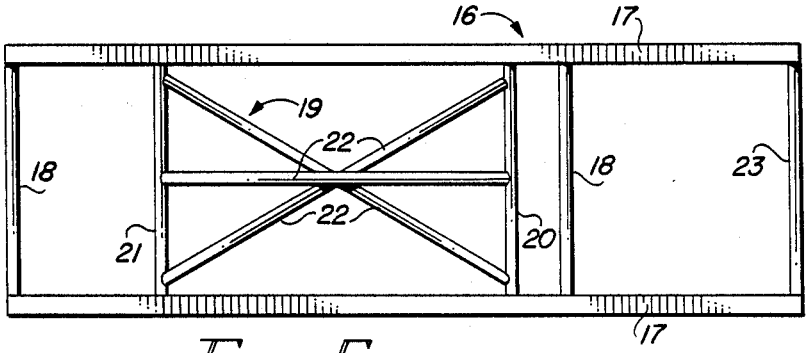
FIG. 5 is a top view of the carriage and associated foot trolley elements of the body stretching and exercising device illustrated in FIG. 1.
Figure 6:
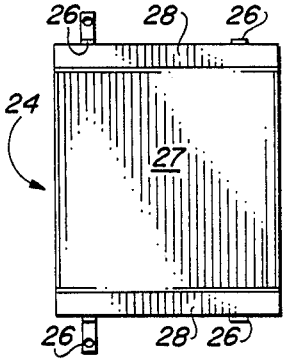
FIG. 6 is a top view of the foot trolley element for slidably mounting on the carriage illustrated in FIG. 5.
Figure 7:
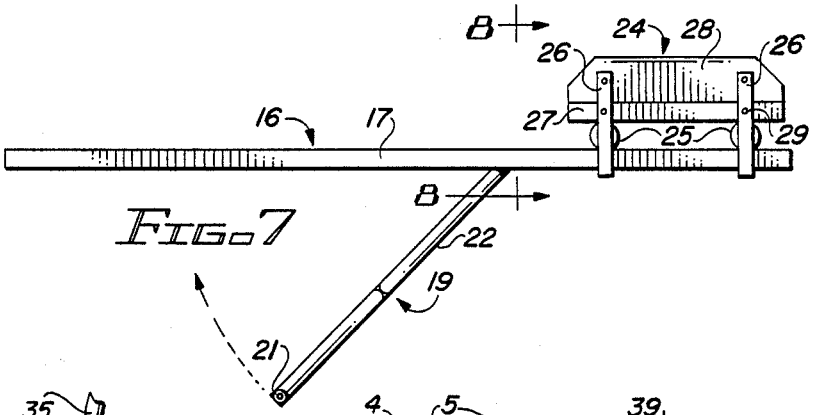
FIG. 7 is a side elevation of the carriage element illustrated in FIG. 5, with the carriage support pivotally extended for angular adjustment of the carriage with respect to the frame.
Figure 8:
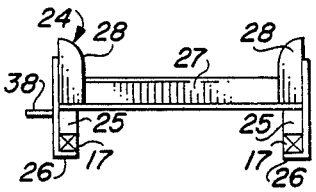
FIG. 8 is a sectional view of the foot trolley and carriage elements, taken along line 8—8 in FIG. 7.
Figure 9:
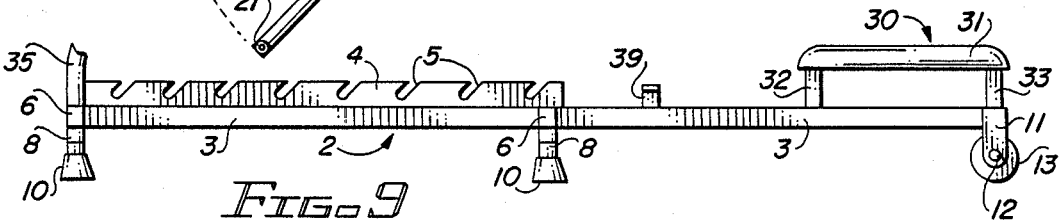
FIG. 9 is a left side elevation, partially in section, of the frame element of the body stretching and exercising device illustrated in FIG. 1.
Figure 10:
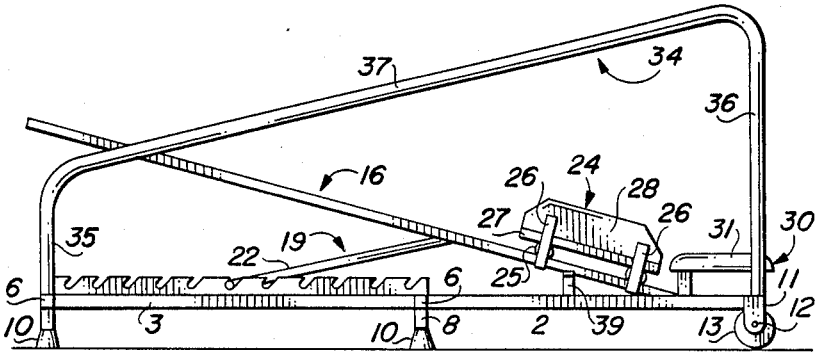
FIG. 10 is a left side elevation of the body stretching and exercising device illustrated in FIG. 1 with the carriage adjustably mounted at a small, acute angle with respect to the frame.

Referring now to FIG. 2 of the drawings, under circumstances where it is desired to stretch the leg and groin muscles with the legs oriented in the horizontal position, one foot is placed on the stationary foot support 30 and the opposite on the foot trolley 24, when the carriage 16 is oriented in horizontal configuration, parallel to the frame 2 and resting on the central frame brace 14 and end frame brace 15, respectively, as illustrated. An exerciser 40 (illustrated in phantom) can then grasp the central handrail segment 37 of the handrails 34 and stretch the leg and groin muscles. Alternatively, and referring now to FIG. 3 of the drawings, under circumstances where it is desired to stretch the leg and groin muscles upwardly in a more vertical configuration, the free end of the carriage 16 is pivoted upwardly with respect to the frame 2 and the slotted plate bar 21, which defines the free end of the carriage support 19, is inserted in a selected parallel pair of the slots 5, in order to support the carriage 16 in a selected, angular relationship with respect to the frame 2. The exerciser 40 then places one foot either on the stationary foot support 30 or on a supporting surface and the other on the foot trolley 24 to advance the foot trolley 24 on the carriage 16 and stretch the leg and groin muscles, as illustrated. As further illustrated in FIG. 10, an intermediate stretching of the leg and groin muscles can be accomplished by adjusting the carriage 16 to a smaller angle with respect to the frame 2 by pivotal operation of the carriage support 19, as described above.

Referring again to FIGS. 1, 4 and 5 of the drawings, in a most preferred embodiment of the invention the parallel carriage rails 17 of the carriage 16 are pivotally secured inside the support members 3 of the frame 2 by operation of the pivot bar 23, in order to facilitate horizontal orientation of the carriage 16 between the support members 3 when the carriage 16 is fully retracted on the frame 2. Furthermore, since the ends of the slotted plate bar 21 extend beyond the carriage rails 17 of the carriage 16 in order to engage the slots 5 in the slotted plate 4, the connector bars 22 are constructed of sufficient length to locate the slotted plate bar 21 beyond the ends of the slotted plates 4 to facilitate fitting of the carriage rails 17 horizontally between the parallel support members 3 in the frame 2, wherein the carriage rails 17 rest on the central frame brace 14 and end frame brace 15. This positioning of the carriage 16 with respect to the frame 2 facilitates parallel orientation of the carriage rails 17 of the carriage 16 inside the support members 3, for horizontal stretching exercises as illustrated in FIG. 2.

It will be appreciated by those skilled in the art that the body stretching and exercising device of this invention affords an efficient, portable and lightweight device for stretching the leg and groin muscles prior to entering into such activities as Karate, track and other athletic activities requiring full warm-up and stretching of these muscles. Furthermore, the body stretching and exercising device is designed to facilitate stretching of the leg and groin muscles in both a horizontal and angular relationship. The body stretching and exercising device is easily transported and moved from one place to another and can accommodate several persons in a short period of time.

While the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is:

1. A body stretching and exercising device comprising a frame; a carriage comprising a pair of elongated carriage rails disposed in substantially parallel relationship; at least one rail spacer spacing said carriage rails at one end thereof and a pivot bar spacing said carriage rails at the opposite end thereof, said pivot bar pivotally attached to said frame, whereby said carriage pivots through a range of motion extending from a first position parallel to said frame to a selected second position disposed in angular relationship with respect to said frame; carriage support means pivotally carried by said carriage rails and adapted to engage said frame, for orienting said carriage at said selected second position with respect to said frame responsive to adjustment of said carriage support means with respect to said frame; and trolley means slidably mounted on said carriage for receiving a first body member and stretching a portion of the first body member responsive to traversal of said carriage by said trolley means.

2. The body stretching and exercising device of claim 1 further comprising stationary support means fixedly carried by said frame for receiving a second body member and stretching a portion of the first body member and the second body member responsive to traversal of said carriage means by said trolley means.

3. The body stretching and exercising device of claim 1 wherein said frame further comprises a pair of elongated carriage support members disposed in substantially parallel relationship, with one end of said carriage means pivotally disposed therebetween; an end bracket spacing said carriage support members at one end thereof and an end frame brace spacing said carriage support members at the opposite end thereof; and a central frame brace spacing said carriage support members intermediate said one end and said opposite end thereof.

4. The body stretching and exercising device of claim 1 further comprising at least one slotted plate fixedly attached to said frame and a plurality of slots provided in said slotted plate in spaced relationship for selectively receiving the free end of said carriage support means and adjusting said carriage means to said selected angle with respect to said frame.

5. The body stretching and exercising device of claim 4 further comprising stationary support means fixedly attached to corresponding ends of said support members for receiving a second body member and stretching a portion of the first body member and the second body member responsive to traversal of said carriage rails by said trolley means, and wherein said pivot bar is pivotally attached to said support members adjacent to said stationary support means.

6. The body stretching and exercising device of claim 4 further comprising:

(a) stationary support means fixedly attached to corresponding ends of said support members for receiving a second body member and stretching a portion of the first body member and the second body member responsive to traversal of said carriage rails by said trolley means, and wherein said pivot bar is pivotally attached to said support members adjacent to said stationary support means; and (b) a pair of handrails mounted on said support members, respectively.

7. The body stretching and exercising device of claim 1 further comprising stationary support means fixedly carried by said frame for receiving a second body member and stretching a portion of the first body member and the second body member responsive to traversal of said carriage means by said trolley means.

8. The body stretching and exercising device of claim 1 further comprising a pair of handrails mounted on said frame.

9. A body member stretching and exercising device comprising a generally horizontally-disposed frame; a stationary foot support fixedly attached to one end of said frame for receiving a first body member; an elongated carriage having one end pivotally attached to said frame adjacent to said stationary foot support and the opposite end of said carriage pivotable into angular relationship with respect to said frame; carriage support means pivotally carried by said carriage and adapted to engage said frame, for orienting said carriage at a selected angle with respect to said frame responsive to adjustment of said carriage support means with respect to said frame; and a foot trolley oriented in close proximity to said carriage; a plurality of wheels rotatably carried by said foot trolley and provided in rolling contact with said carriage; and at least two trolley guides carried by said foot trolley in oppositely-disposed relationship, said trolley guides projecting beneath said carriage for retaining said foot trolley on said carriage responsive to traversal of said foot trolley along said carriage, said foot trolley adapted for receiving a second body member and stretching a portion of the first and second body member responsive to traversal of said carriage by said foot trolley.

10. The body member stretching and exercising device of claim 9 wherein said frame further comprises a pair of elongated support members disposed in substantially parallel relationship, with one end of said carriage pivotally disposed therebetween; an end bracket spacing said support members at one end thereof and an end frame brace spacing said support members at the opposite end thereof; and a central frame brace spacing said support members intermediate said one end and said opposite end thereof.

11. The body member stretching and exercising device of claim 10 wherein said carriage further comprises a pair of elongated carriage rails disposed in substantially parallel relationship; at least one rail spacer spacing said carriage rails at one end thereof and a pivot bar spacing said carriage rails at the opposite ends thereof, said pivot bar pivotally attached to said support members, wherein said carriage rails pivot at said opposite ends through a range of motion extending from a first position between said support members to a selected second position disposed in angular relationship with respect to said support members.

12. The body member stretching and exercising device of claim 9 wherein:

(a) said frame further comprises a pair of elongated support members disposed in substantially parallel relationship; an end bracket spacing said support members at one end thereof and an end frame brace spacing said support members at the opposite end thereof; and a central frame brace spacing said support members intermediate said one end and said opposite end thereof; and (b) said carriage further comprises a pair of elongated carriage rails disposed in substantially parallel relationship; at least one rail spacer spacing said carriage rails at one end thereof and a pivot bar spacing said carriage rails at the opposite ends thereof, said pivot bar pivotally attached to said support members, whereby said opposite ends of said carriage rails are pivotally carried by said support members and wherein said carriage rails pivot at said opposite ends through a range of motion extending from a first position between said support members to a selected second position disposed in angular relationship with respect to said support members.

13. A body member stretching and exercising device comprising a generally horizontally-disposed frame; a pair of handrails extending upwardly from said frame in spaced, substantially parallel relationship; a stationary foot support fixedly attached to one end of said frame for receiving a first body member; an elongated carriage having one end pivotally attached to said frame adjacent to said stationary foot support and the opposite end of said carriage pivotable into angular relationship with respect to said frame; trolley means slidably mounted on said carriage for receiving a second body member and stretching a portion of the first and second body member responsive to traversal of said carriage by said trolley means; and carriage support means pivotally carried by said carriage and adapted to engage said frame, for orienting said carriage at a selected angle with respect to said frame responsive to adjustment of said carriage support means with respect to said frame.

14. The body member stretching and exercising device of claim 13 wherein:

(a) said carriage further comprises a pair of elongated carriage rails disposed in substantially parallel relationship; at least one rail spacer spacing said carriage rails at one end thereof and a pivot bar spacing said carriage rails at the opposite ends thereof, said pivot bar pivotally attached to said frame, whereby said opposite ends of said carriage rails are pivotally carried by said frame and wherein said carriage rails pivot at said opposite ends through a range of motion extending from a first position substantially parallel to said frame, to a selected second position disposed in angular relationship with respect to said frame; and (b) said trolley means further comprises a foot trolley oriented in close proximity to said carriage; a plurality of wheels rotatably carried by said foot trolley and provided in rolling contact with said carriage rails; and at least two trolley guides carried by said foot trolley in oppositely-disposed relationship, said trolley guides projecting beneath said carriage rails for retaining said foot trolley on said carriage rails responsive to traversal of said foot trolley along said carriage.

* * * * *